United States Patent [19]

Betts et al.

[11] Patent Number: 4,839,988

[45] Date of Patent: Jun. 20, 1989

[54] PANIC EXIT DEVICE

[75] Inventors: John E. Betts, Garden Grove; George Toledo, San Diego, both of Calif.

[73] Assignee: Thomas Industries Inc., Louisville, Ky.

[21] Appl. No.: 172,642

[22] Filed: Apr. 6, 1988

[51] Int. Cl.[4] ..... E05B 65/10

[52] U.S. Cl. ..... 49/141; 49/395; 292/21; 292/92

[58] Field of Search ..... 49/141, 395; 292/21, 292/92, 167

[56] References Cited

U.S. PATENT DOCUMENTS

| | | | |
|---|---|---|---|
| 3,334,500 | 8/1967 | Bejarano | 292/21 X |
| 3,663,047 | 5/1972 | Zawadzki | 292/21 X |
| 3,940,886 | 3/1976 | Ellingson, Jr. | 49/141 X |
| 3,993,335 | 11/1976 | Schmidt | 292/21 |
| 4,083,590 | 4/1978 | Folger | 292/21 X |
| 4,130,306 | 12/1978 | Brkic | 292/21 X |
| 4,167,280 | 9/1979 | Godec et al. | 292/21 X |
| 4,225,163 | 9/1980 | Hubbard et al. | 292/21 |
| 4,295,673 | 10/1981 | Miller | 49/141 X |
| 4,384,738 | 5/1983 | Floyd | 292/92 |

*Primary Examiner*—Philip C. Kannan

[57] ABSTRACT

The invention disclosed herein provides a panic exit device for doors having in their active side vertically operating bolts extending from the top and bottom of the door and a mechanism for retracting the bolts. Usually, the retracting mechanism may be activated by using a key in an exterior door lock or by depressing a panic bar on the interior of the door. The improved panic exit device of this invention provide a device for actuating the bolt retraction mechanism which is mounted inside a semi-hollow enclosure which is integral with the door. The mounting is accomplished with screws hidden from view by the glass pane securing mouldings. The panic exit device of the invention also provides an improved dogging mechanism to lock the actuator device in the actuated position, while simultaneously preventing excessive play in the panic bar.

17 Claims, 8 Drawing Sheets

PANIC EXIT DEVICE

BACKGROUND OF THE INVENTION

Field of the Invention

This invention relates to panic exit devices having one or more vertically operating bolts at the top and/or bottom of the door. An example of such a device wherein the bolts may be retracted solely by means of a key operated lock which also services to lock the bolts in the retracted position or by depressing a panic bar, is described in the U.S. Patent to T. Bejarano, U.S. Pat. No. 3,334,500. Other examples of such a device are disclosed in the U.S. Patent to Schmidt, U.S. Pat. No. 3,993,335 and Hubbard et al, U.S. Pat. No. 4,225,163.

There are numerous types and styles of mechanisms used for operating the popular commercial and industrial door latch where the bolts reciprocate vertically and extend from the top and bottom of the door. Most of these mechanisms include or are adapted to include a panic bar release arrangement on the inside of the door for rapid and foolproof actuating of the bolts by merely depressing the panic bar to open the door. Many such mechanisms include an often desirable feature of permitting manipulation of a device to latch the bolts in a retracted position during business hours or the like, whereby the door is free to swing open without operating the panic bar or hitting any other release mechanism. This is known in the industry as a "dogging" feature and is usually accomplished by flipping a lever or threading a screw into a position to block the operating mechanism in the depressed position of the panic bar or other release mechanism. Often, it is particularly desirable that this dogged condition of the door not be inadvertantly or maliciously released and therefore, a special tool or unique knowledge might be required to set and release the dogging mechanism. For example, a recessed screw has been used as the actuating means for the dogging mechanism whereby a screwdriver and considerable effort are needed for actuation, but this has the inherent objectionable feature of requiring a substantial amount of the authorized operator's time to actuate the dogging mechanism. Another now-conventional arrangement as shown in the aforementioned U.S. Pat. No. 3,334,500 provides a pivotable stud having a relieved shank portion adapted to engage a portion of the bolt retraction mechanism so as to reach a dogged condition with a ½ turn rotation of the stud. Although this dogging arrangement is an improvement over other methods, it results in the tension being removed from the panic bar handle, leaving it in a flopable condition.

In U.S. Pat. No. 3,993,335 a dogging arrangement is disclosed wherein a recessed pin is elevated and rotated to move the actuator bar into an actuated position while simultaneously restraining the panic bar from returning to the inactive position.

Another feature that is often required with this type of bolt mechanism is the provision of a keyed exterior lock to permit opening of the door from the outside. Conventionally, these mechanisms are provided with an exterior lever or knob which is released by the operation of the keyed lock and then may be manipulated to retract the bolts for opening the door. Alternatively, the keyed lock may operate a separate bolt which must be released before the door may be opened by the operation of the knob or lever. U.S. Pat. No. 3,334,500 provides a vertical bolt operating mechanism capable of actuation by an exterior keyed lock, wherein the bolts may be latched in their retracted position by appropriate manipulation of the keyed lock in conjunction with manipulation of an interiorly facing operating means, and that arrangement is particularly suitable for and compatible with the present invention.

Still another desirable feature in many installations of this type of bolt mechanism is to minimize the size of both the door stile containing the bolts and the mechanism for operating the bolts. This is particularly desirable with glass doors which derive their esthetic quality from their uncluttered look. The particular locking mechanism disclosed by Bejarano allows such a narrow door stile. Additionally, it is desirable to provide an exit device which may be easily and economically mounted on the door stile, regardless of whether the bolt mechanism is on the left hand or right hand stile.

To provide smooth operation of installations of this type, some form of bolt latching mechanism is usually provided which retains the bolts in the retracted position when the interior or exterior actuating device is operated during the time the door is open. This prevents the need to continue pressure on the panic bar or key in order to prevent the bolt from contacting the ground while the door is swinging open and closed. The bolt latching mechanism is usually designed to trip and release the bolt when the door reaches the closed position. U.S. Pat. No. 3,334,500 shows such a latching mechanism. However, latching mechanisms of this type have proved unsatisfactory, since the bolt which is screwed on the connecting shaft must be rotated a full 360° in order to vary the portion of the bolt which extends above and below the door. This often results in situations where one turn more is too much, but the present length is not enough. U.S. Pat. No. 3,993,335 discloses an arrangement for providing the bolt latching means and hexagonal locking bolts within a conventional retraction mechanism so that the distance the bolts protrude above or below the door stile may be adjusted with precision.

SUMMARY OF THE INVENTION

The invention provides for the mounting of a novel actuator device on the internal side of the door causing the vertical movement of the projecting actuating pin of a particular type of conventional retraction mechanism for vertically operating bolts which retracts the bolts. The actuator device comprises an active unit assembly mounted in a semi-hollow enclosure which is integral with the door, and engages the actuating pin in the active stile. The actuator device is mounted with screws hidden by the glass pane securing mouldings. The bolt retraction mechanism is mounted in a fixed position in the interior of the active stile with screws hidden by the glass pane and glass pane securing mouldings.

Another object is to provide a novel linkage arrangement between the manually depressible panic bar and the actuating pin engaging arm to translate horizontal movement of the bar into vertical movement of the pin.

An object of the invention is to provide a panic exit device which has a flush mounted type of appearance and is esthetically desirable for an uncluttered look.

Another object of this invention is to provide a novel form of dogging means for the actuator device wherein a spring biased dogging pin is concealed behind a small opening/aperture and yet is readily operable by authorized personnel by appropriately turning the dogging pin, depressing the panic bar, and releasing the dogging pin.

A still further object is to provide such an arrangement in which, in the dogged position, the panic bar of the device is securely held in the depressed position by the dogging pin.

Yet another object of the invention is to provide a novel actuator lever shaped to engage only the underside of the actuating pin of a conventional retraction mechanism to thereby allow the panic exit device to return to its normal, undepressed position even though the actuating pin remains in the upper, bolt retraction position.

DETAILED DESCRIPTION OF THE PREFERRED EMBODIMENTS

Figure 1:
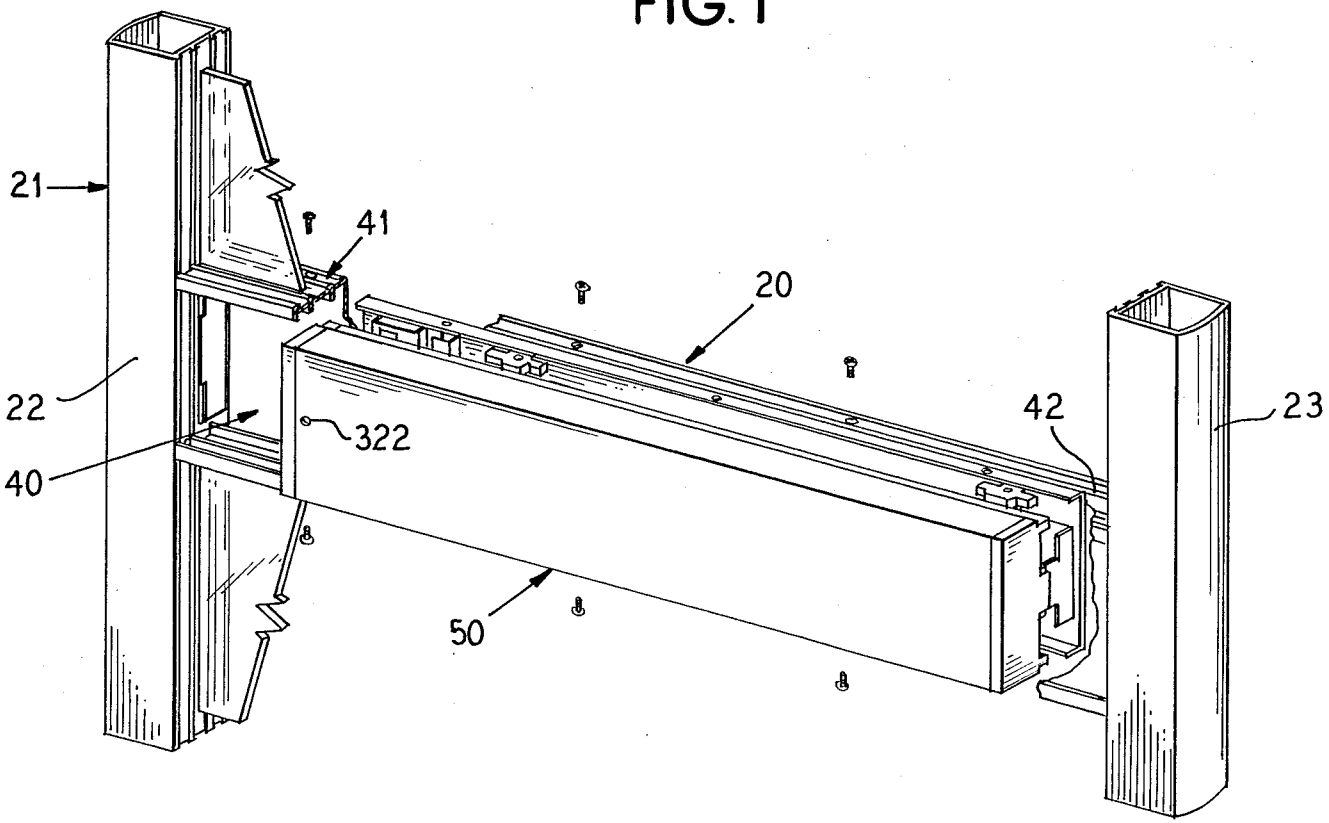
FIG. 1 is a fragmentary perspective exploded view of an embodiment of the invention showing the mounting relationship of the actuator device the inactive and active stiles and mounting box.
Figure 2:
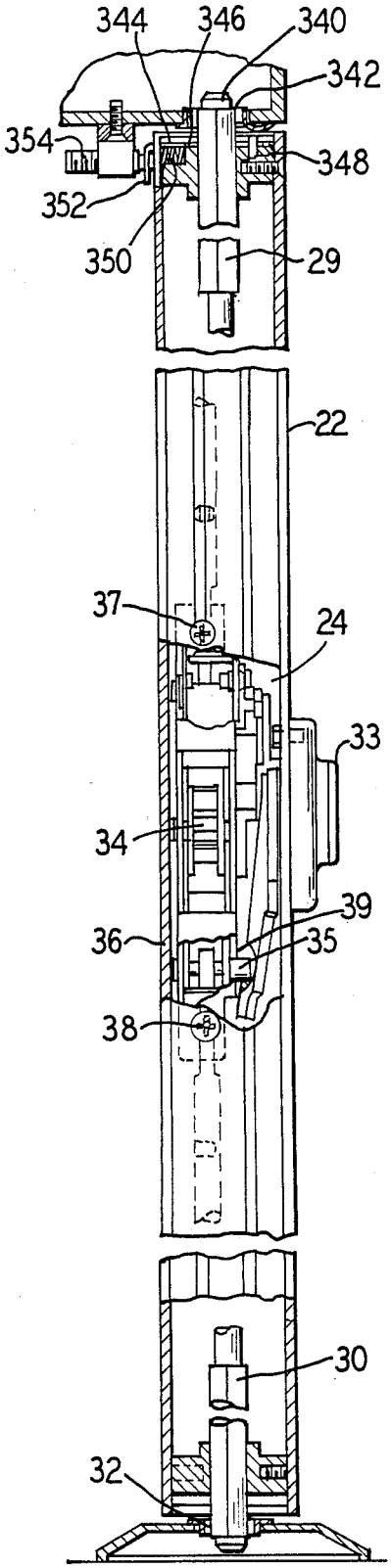
FIG. 2 is a sectional side elevation of an active door stile of the invention with the locking mechanism mounted therein and the actuator device mounted on the stile in the inactive position.

In one embodiment, depicted in FIG. 1, a panic exit device 20 of the invention is mounted in a door 21 having active stile 22 and inactive stile 23, it being understood that the term "active stile" merely refers to the edge of the door which opens and closes and "inactive stile" refers generally to the hinged side of the door. Although active stile 22 and inactive stile 23 as depicted are of a design suitable for framing a glass door, it is within the scope of the invention to mount the panic exit device in any type of door having an active stile as hereinafter described. Mounted internally in the active stile is a locking bolt retraction mechanism, generally designated 24 and more clearly depicted in FIGS. 2–5. The locking bolt retraction mechanism 24 is described in detail in U.S. Pat. No. 3,993,355 and includes connector rods 25 and 26 and springs 27 and 28 which urge the connector rods upwardly and downwardly respectively. Locking bolts 29 and 30 are threadably mounted on the end of connector rods 25 and 26 respectively so that in the normal locked, extended position they engage openings 31 and 32 in the doorway to lock the door in the closed position. The retraction mechanism 24 may be actuated to cause reciprocating vertical retraction movement of locking bolts 29 and 30 by inserting and turning a key in key mechanism 33, thereby rotating lever arm 34.

Alternatively, the actuating mechanism may be actuated by the vertical movement of actuating pin 35. The retraction mechanism is essentially mounted in retraction mechanism case 36 which is securely fastened to active stile 22 by screws 37 and 38. Actuating pin 35 protrudes through slot 39 in case 36.

Mounted through a front opening 40 of a housing 41 forming a rail 42 of the door, extending between the door stiles 22, 23 there is provided an actuator device embodying the principles of the present invention generally designated as 50 and more clearly depicted in FIGS. 8–13. The actuator device 50 is comprised of a mounting base 52 with control arms 54 and 56 pivotally mounted at first ends 58, 60 on vertical shafts 62 and 64 which are captured axially in openings 66, 68 in the base 52. Shafts 62 and 64 are secured by means of mounting brackets 70, 72, 74, 76. Each mounting bracket has a vertical hole 78 therethrough to accept one end of one of said shafts. The mounting brackets are attached to base 52 by appropriate fastening means such as screws 80.

A panic bar 90 is attached to control arms 54 and 56 by means of rollers 92, 94, 96, 98 which are captured in channels 100, 102 formed integral in a top wall 104 and a bottom wall 106 of the panic bar 90. Rollers 92, 94, 96, 98 each have a hole 108 therein to accept shafts 110 and 112 which are mounted through holes 114 in second ends 116, 118 of control arms 54 and 56. The second ends 116, 118 of control arms 54 and 56 are connected together with upper and lower connecting links 120 and 122 which have holes 124, 126 therethrough to receive shafts 110 and 112.

Figure 9B:
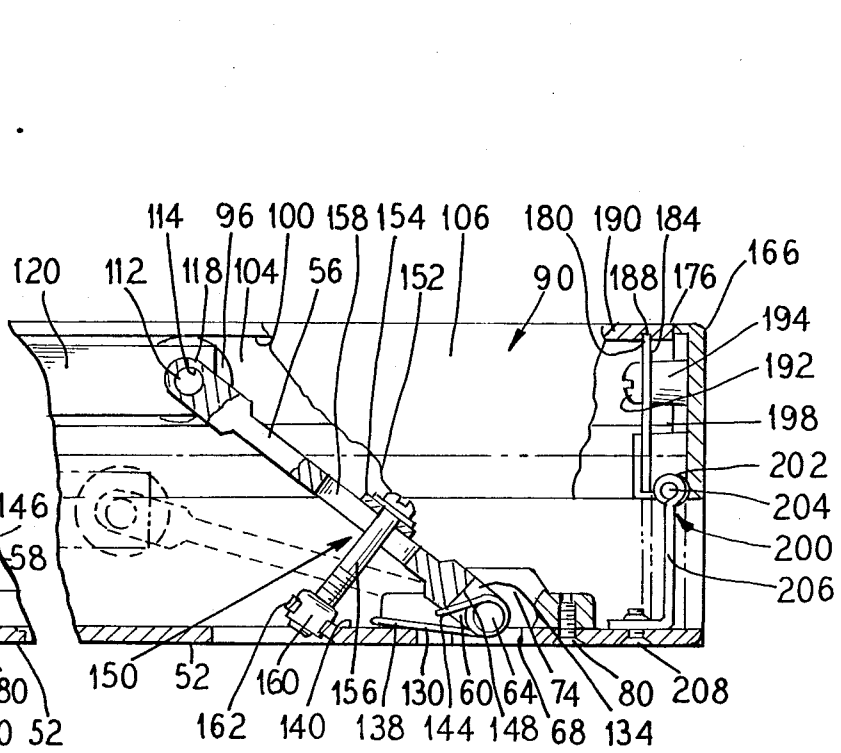
FIG. 9*b* is a fragmentary top view partially in section of the right side of the actuator device of the invention shown in the inactive position.
Figure 9A:
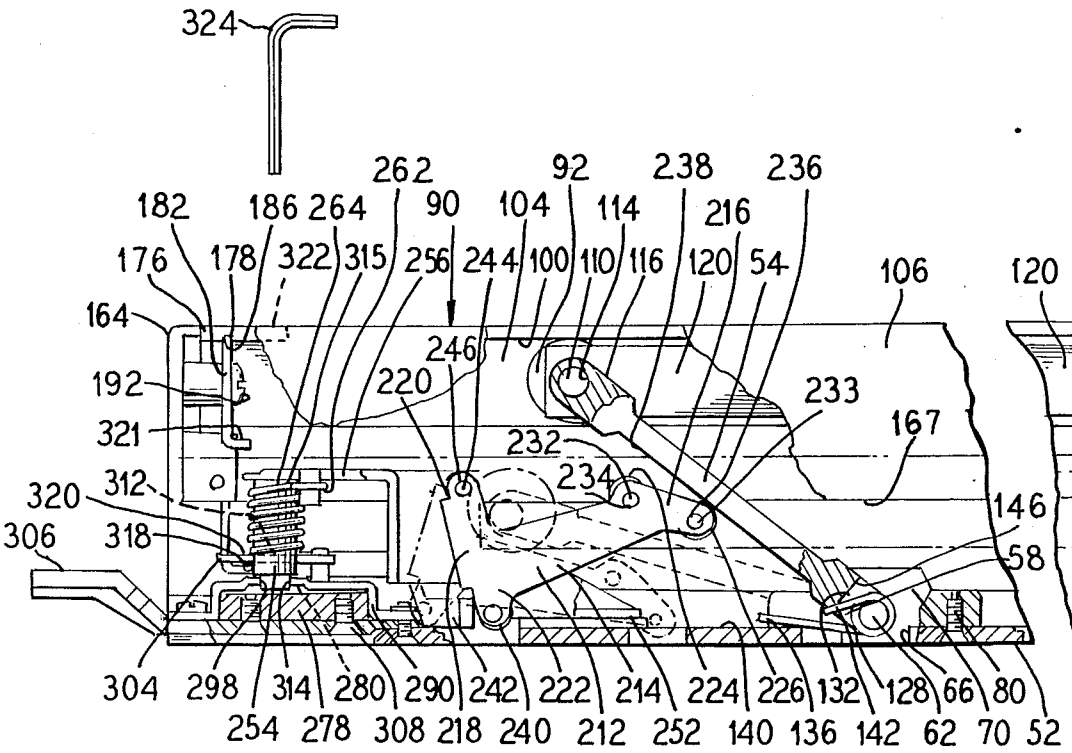
FIG. 9*a* is a fragmentary top view partially in section of the left side of the actuator device of the invention shown in the inactive position.
Figure 10:
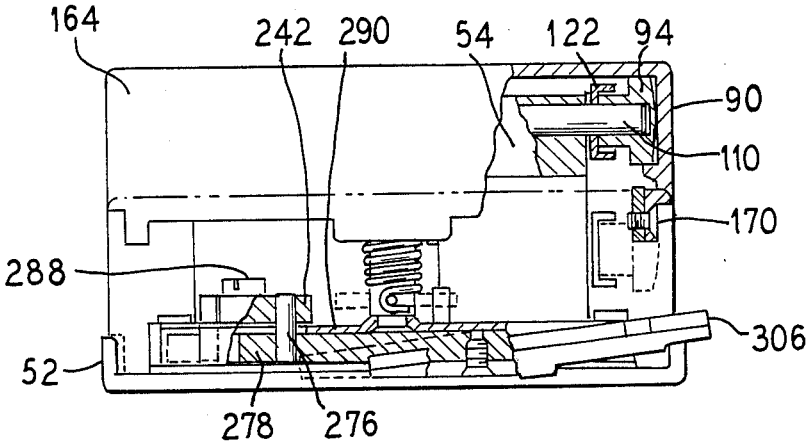
FIG. 10 is a fragmentary left end elevation partially in section of the actuator device of the invention shown in the inactive position.
Figure 11:
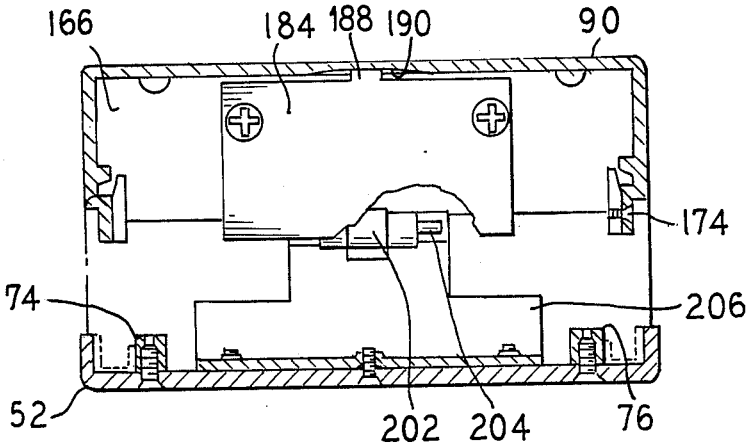
FIG. 11 is a fragmentary right end elevation partially in section of the actuator device of the invention shown in the inactive position.

An outwardly biasing means for panic bar 90 is provided in the form of springs 128 and 130 which are contained by the encircling of end portions of said springs on shafts 62 and 64 in cut-outs 132, 134 at the first or pivotal ends 58, 60 of control arms 54 and 56. A central portion 136, 138 of said springs 128, 130 engages against a front face 140 of the base 52 and ends 142, 144 of the springs are held against an edge 146, 148 of the cutouts 132, 134 so that the control arms 54, 56 are constantly biased in a clockwise direction around an axis of shafts 62, 64 as seen in the view of FIGS. 9*a* and 9*b*.

A maximum outward biased position of panic bar 90 is controlled by a stop mechanism 150, consisting of a washer 152 and fabric washer 154 positioned on a screw 156 which is placed into a slot 158 of control arm 56 and is accepted by a threaded insert 160 which is attached to a formed tab 162 of mounting base 52. When the panic bar 90 is depressed, the control arm 56 moves away from the washers 152, 154 and the slot 158 provides clearance for the screw 156. As the panic bar 90 returns to the outward position, the control arm 56 comes into engagement with the fabric washer 154 which cushions and silences the stopping impact.

End covers 164 and 166 are attached to a rear edge 167 of panic bar 90 with screws 168, 170, 172, 174 and supported at a front edge 176 by tongues 178, 180 on end cover brackets 182 and 184, which fit into grooves 186, 188 on the inside of a front wall 190 of panic bar 90. The brackets 182, 184 are attached to end covers 164, 166 by screws 192.

Further, end cover bracket 184 is supported by bosses 194, 196 on end cover 166 which provides a space or channel 198 for a controlling means 200 to prevent excessive lateral movement of the panic bar 90. The controlling means 200 comprises a roller 202 carried on a pin 204 which is attached to an end-play bracket 206, which in turn is secured to mounting base 52 by screws 208. The roller 202 rides in the space 198 between the end cover bracket 184 and the end cover 166 providing relatively linear movement of the panic bar in a direction normal to the front wall 190 of the panic bar 90.

An actuating mechanism 210 consists of an L-shaped primary lever 212 having a long leg 214 with a distal end 216 and a short leg 218 with a distal end 220, the legs joining at junction 222. Rollers 224 and 226 are attached between side arms 228, 230 of the L-shaped lever 212 at the distal end 216 of the long leg 214 by pins 232, 233 placed in holes 234, 236 of the lever with the rollers contacting an underside face 238 of control arm 54. A roller 240 is attached in similar fashion at the junction 222 and contacts an actuator lever 242.

Primary lever 212 is attached with a vertically oriented pin 244 through holes 246 in the lever near the distal end 220 of the short leg 218 and holes 248 in a primary lever bracket 250 thus allowing for pivotal motion of primary lever 212. Primary lever bracket 250 rests on a mounting plate 252 and is attached to the mounting base 52 through holes in the mounting plate. Another function of primary lever bracket 250 is to support and provide a pivotal bearing means for an end of a dogging pin 254. This bearing means is provided by a tab 256 with hole 258 for the dogging pin 254. The tab 256 also has a projecting member 260 for hooking one end 262 of a dogging pin spring 264.

The actuator lever 242 is a right angle "L" shaped part with two arms 266, 268 extending, one of which (268) has a convex shape at a distal end 270 for engaging roller 240. The other arm 266 at a distal end 272 has a hole 274 for accepting a pin 276 which engages an actuator slide 278 through an aperture 280 in a slide cover 282.

The actuator lever 242 has a hole 284 at a junction 286 where the arms 266, 268 of the lever converge and allows for pivotal movement around a horizontally oriented screw 288 which attaches the lever 242 to the mounting plate 252 through the hole 284.

The actuator slide 278 engaged by the pin 276 is constrained to move only in a vertical linear manner. A slide cover 290 overlies the actuator slide 278 and forms a vertical channel 292 within which the slide 278 moves. The slide cover 290 rests on the mounting plate 252 and is attached to the mounting base 52 through holes in the mounting plate.

Another function of the slide cover 290 is to support and provide a pivotal bearing means for an end 294 of dogging pin 254 which is accomplished by an outwardly protruding boss 296 and a hole 298 for pivotally receiving the end of the pin 254. Another function provided by the slide cover 290 is a limiting of the rotational movement of dogging pin 254. This is accomplished by outwardly directed tabs 300, 302 which are engageable by a roll pin 304 carried on the dogging pin 254.

A slide lever 306 is attached to the rear side of actuator slide 290 by screws 308 engaging into holes provided in said actuator slide 290. Slide lever 306 has an arm 310 which is positioned under the actuating pin 35. The arm provides the vertical movement means for actuating pin 35.

Figure 12A:
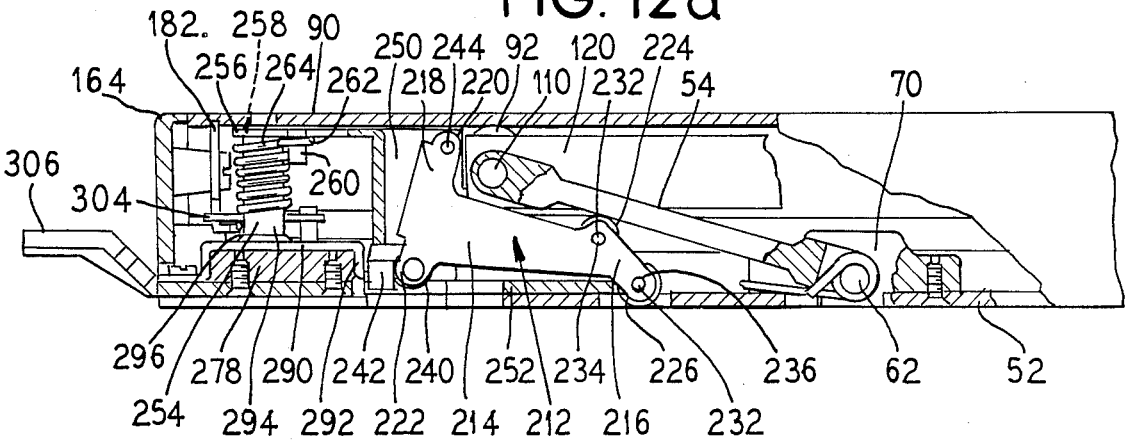
FIGS. 12*a* and 12*b* are fragmentary sectional elevations similar to FIGS. 9*a* and 9*b* of the actuator device of the invention shown active position.
Figure 12B:
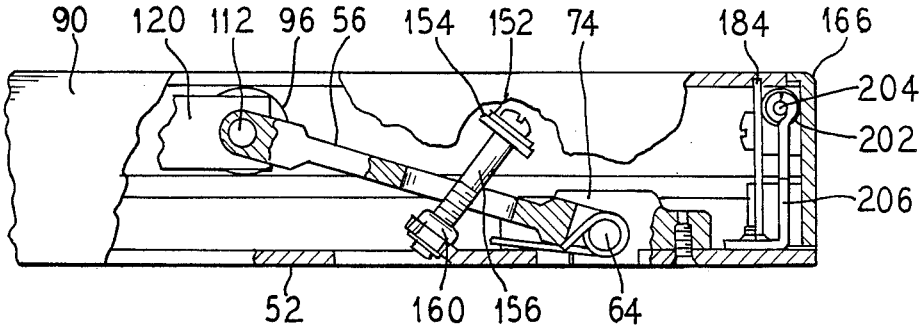
Figure 13:
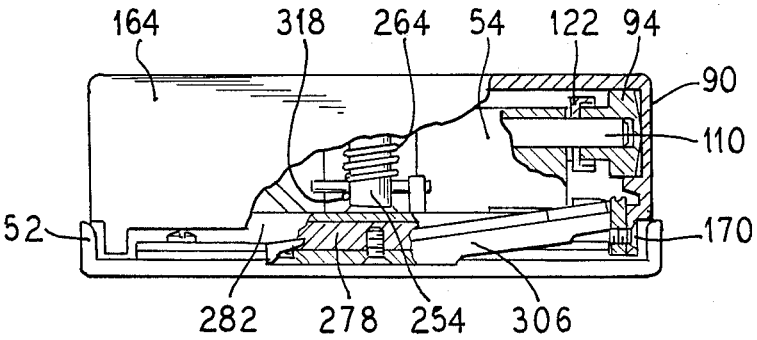
FIG. 13 is a fragmentary end elevation similar to FIG. 10 of the actuator device of the invention shown in the active position.

The dogging device consists of the dogging pin 254 which has the roll pin 304 mounted in a lateral hole 312 therein, projecting laterally therefrom. The dogging pin restraining means is best depicted in FIGS. 9 and 12. In this embodiment the dogging pin 254 is provided with relieved ends 314, 315 which are smaller in diameter than the body and are mounted in holes, the bottom hole 298 which is provided by the slide cover 290 and the top hole 258 which is provided by the tab 256 on the primary lever bracket 250.

Figure 8A:
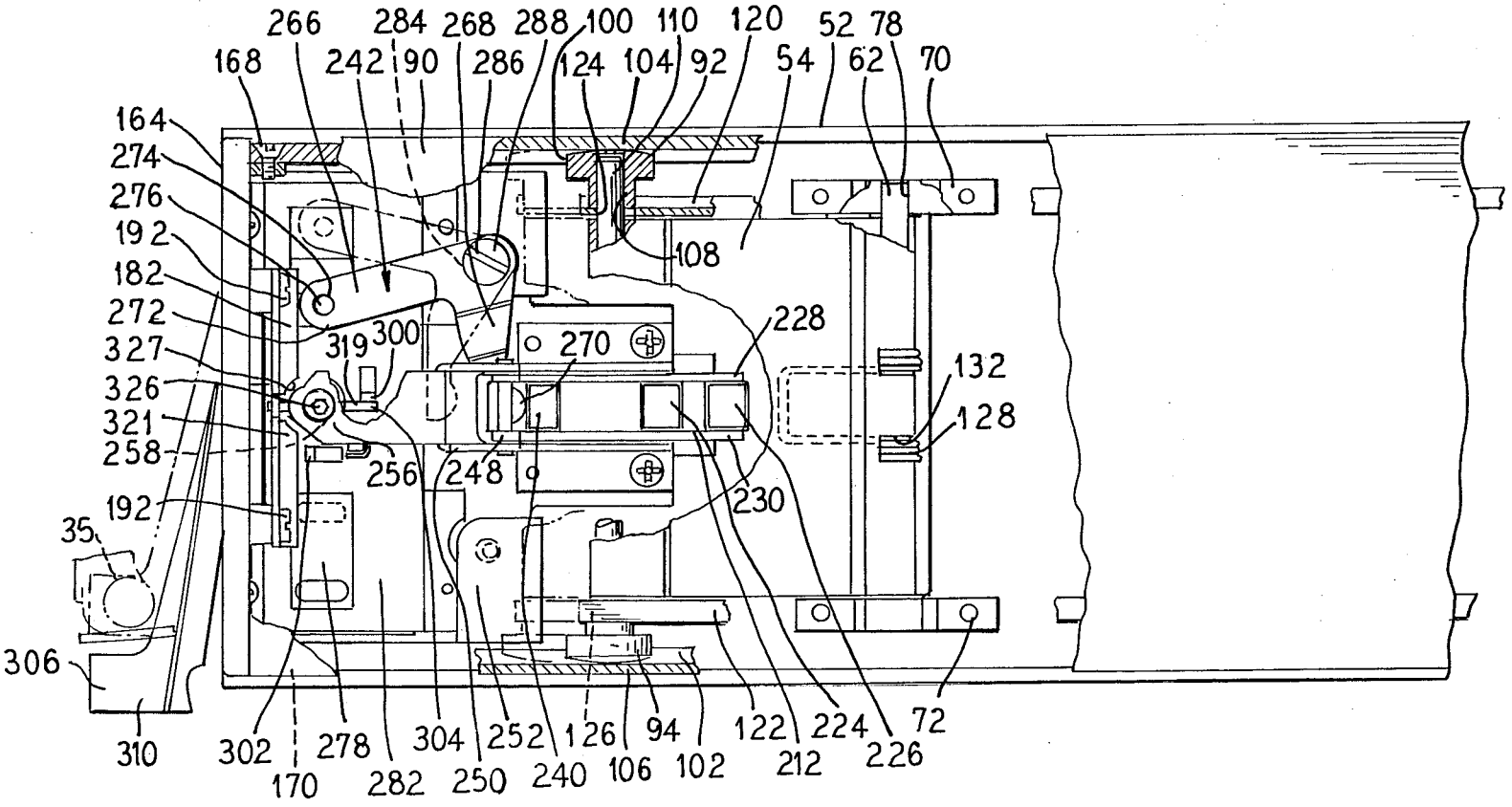
FIG. 8*a* is a fragmentary front view partially in section of a left side of an actuator device of the invention shown in the inactive position.
Figure 8B:
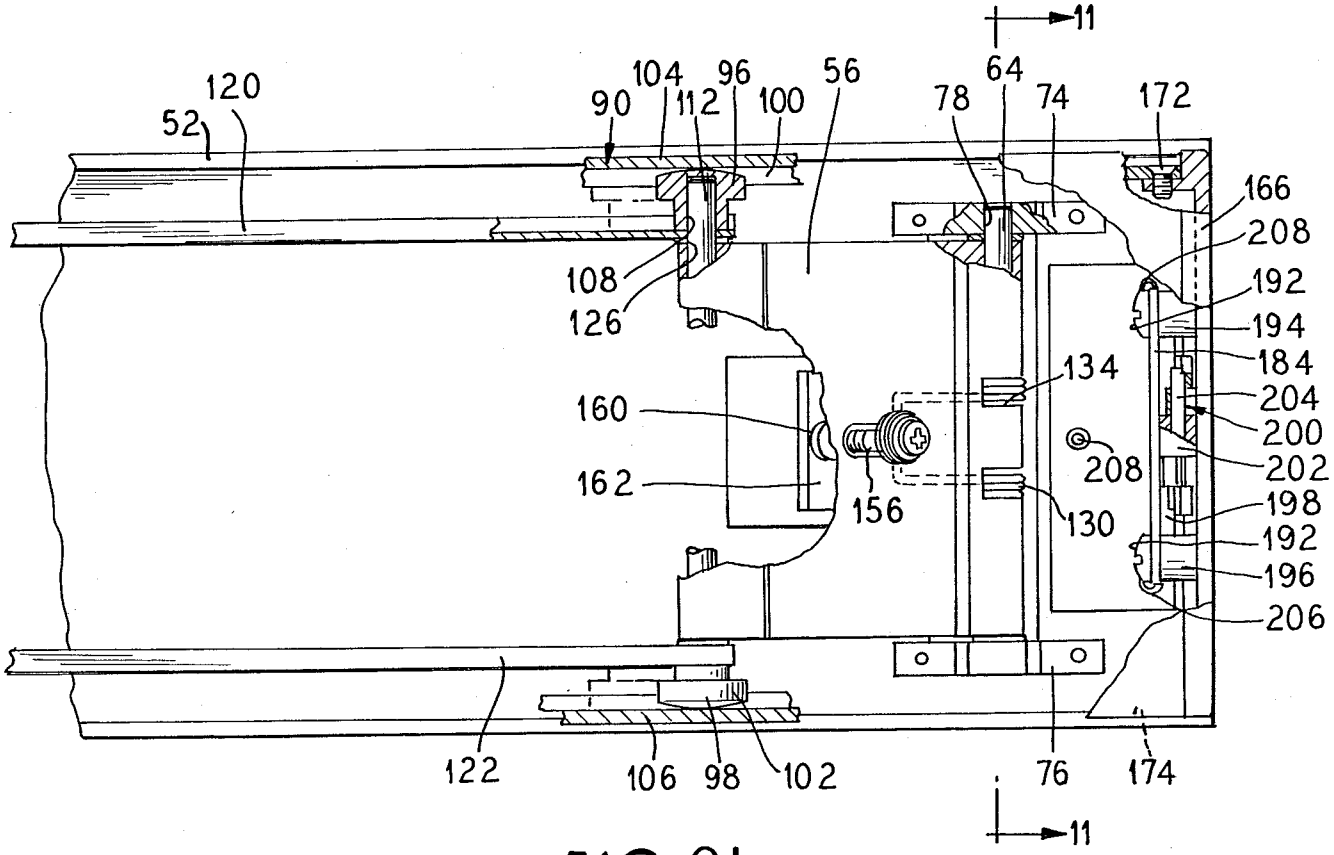
FIG. 8*b* is a fragmentary front view partially in section of a right side of the actuator device of the invention shown in the inactive position.

The dogging pin spring 264 with hooked ends 318, 262 is mounted on dogging pin 254, one end 318 of which is hooked around laterally mounted roll pin 304. The other end 262 of the spring 264 is hooked around the formed tab 260 on primary lever bracket 250, thus applying tension to roll pin 304. This forces one end 319 of the roll pin 304 against the formed outwardly projecting tab 300 on slide cover 290. In this position a second end 320 of the roll pin 304 is prevented from engaging a ledge 321 on end cover bracket 182 as depicted in FIG. 8.

The panic bar 90 is provided with an aperture 322 near the active stile to allow passage of a dogging key 324 through to the dogging device. Dogging is accomplished by inserting the dogging key 324 through the aperture 322 to engage in a complementarily shaped recess 326 formed in the end 315 of the dogging pin. For example, the dogging key may have a hexagonal shape and the recess 326 would also be hexagonally shaped. The dogging key 324 is rotated clockwise 90° to move the one end 319 of the roll pin 304 away from the tab 300 and into engagement with the tab 302. In this orientation the roll pin 304 will be positioned vertically and laterally spaced from the ledge 321. The panic bar 90 can then be fully depressed, and when held in the fully depressed position, the dogging pin 254 is permitted to rotate counter-clockwise causing the second end 320 of the roll pin 304 to overlie the ledge 321 and lock the panic bar 90 in the active position. The panic bar can be undogged by rotating the dogging pin 254 clockwise with the dogging key 324 to disengage the second end 320 of the pin 304 from the ledge 321.

The active position occurs when the panic bar 90 is depressed causing the rollers 92, 94, 96, 98 to roll in the channels 100, 102 of the panic bar 90 due to swinging arc motion of the control arms 54 and 56. The ledge 321 has a slot 327 to prevent engagement between the ledge 321 and the second end 320 of the roll pin 304 as the panic bar 90 is depressed.

The underside face 238 of the control arm 54 pressing against the rollers 224 and 226 causes pivotal movement of the primary lever 212 and right to left motion of the roller 240. The roller 240 presses against the actuator lever 242 causing clockwise pivotal motion and upward movement of the pin 276, while the pin 276 engaged in the actuator slide 278, causes upward vertical movement of the actuator slide. The slide lever 306, being attached to the actuator slide 278, also moves vertically carrying with it the actuating pin 35 to move the bolts 29, 30 into the active position.

When force on the panic bar is released, the springs 128 and 130 cause the panic bar 90 to move away from the mounting base 52. Since the actuator slide arm 310 engages only an underside of the actuating pin 35, it is free to move away from the pin, under the influences of gravity, even though the actuating pin 35 may remain in an elevated position. As discussed in U.S. Pat. No. 3,993,335 it is desireable to restrain the locking bolts 29, 30 in the retracted position while the door 21 is open.

Figure 6:
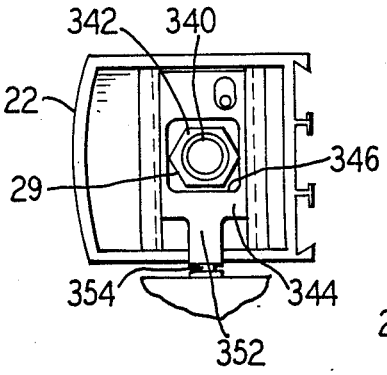
FIGS. 6 and 7 are plan views of the latching mechanism taken along the line 6—6 and 7—7 shown in FIG. 3 and FIG. 5 respectively, with FIG. 6 illustrating the tripped configuration of the mechanism, such as when the door is closed, and FIG. 7 illustrating the configuration for swinging of the door.
Figure 7:
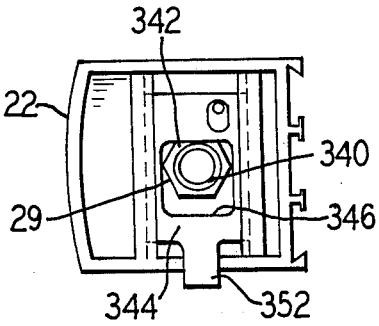
Figure 3:
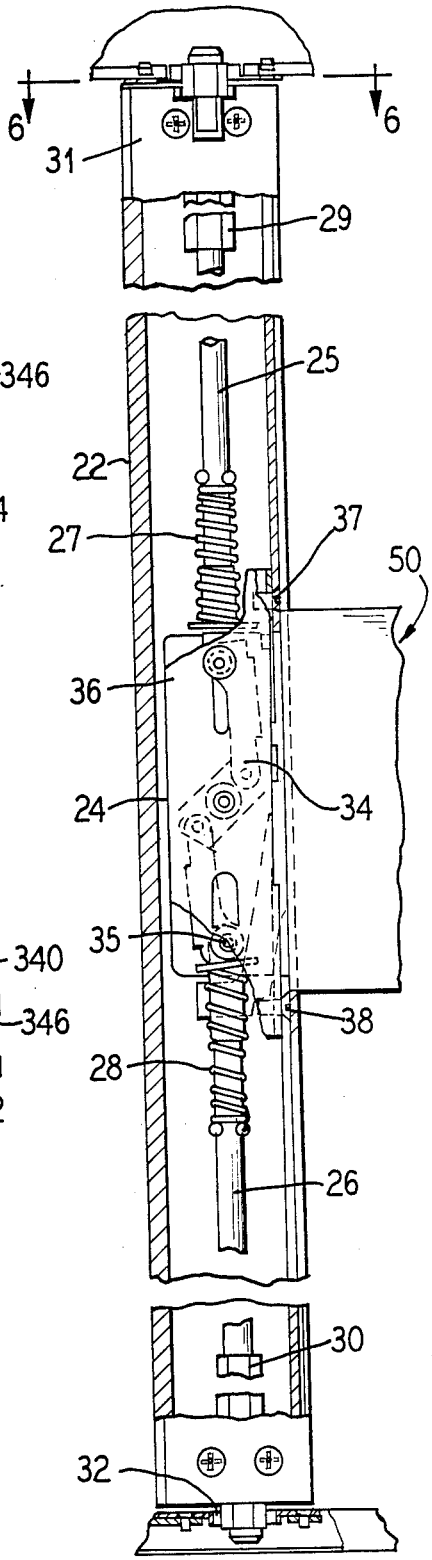
FIG. 3 is a fragmentary sectional elevation of the active door stile taken from the interior side of the stile with the locking mechanism in the inactive position.
Figure 4:
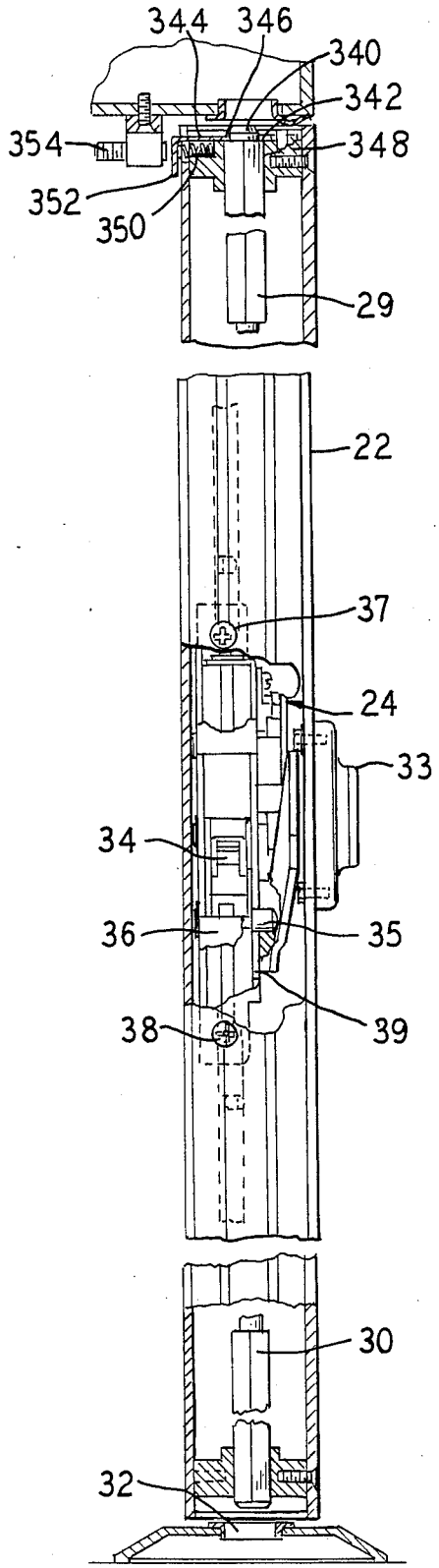
FIG. 4 is a sectional side elevation of an active door stile of the invention showing the locking mechanism therein and actuator device mounted on the active stile in the active position.
Figure 5:
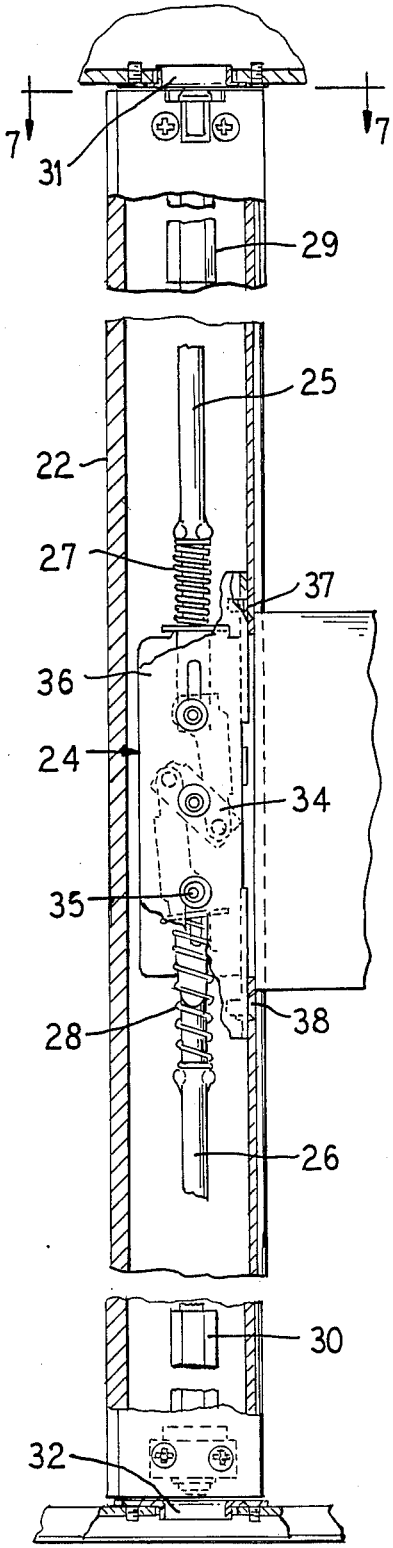
FIG. 5 is a fragmentary sectional elevation of the active door stile taken, from the interior side of the stile with the locking in the active position.

The latching means is best depicted in FIGS. 4, 6 and 7. In this embodiment locking bolt 29 is hexagonal in cross section and is provided with head portion 340 smaller in diameter than the body of locking bolt 29 and thus creating ledge 342 around the head portion. The latching means comprising slidable member 344, provided with aperture 346, is slidably mounted in mounting member 348 and biased in the latching position depicted in FIG. 7 by spring 350. When the door is in the closed position, protrusion 352 on slidable member 344 engages protrusion 354 connected to the doorway to force member 344 to the position depicted in FIG. 6 thereby disengaging bolt 29 and allowing it to freely pass through aperture 346. It can be seen that when retraction mechanism 24 is actuated to retract bolts 21 and 30, and active stile 22 is swung away from protrusion 354, slidable member 344 will assume the position shown in FIG. 7, and will restrain bolts 29 and 30 from returning to the locking position even after the key has been withdrawn from locking mechanism 33 or the upward force is removed from actuator pin 35. Locking bolts 29 and 30 have a hexagonal cross section, and support member 348 is provided with aperture 356 which has opposite sides spaced apart to slidably engage bolt, but to prevent it from rotating within support member 348. A similar apertured support member 358 is provided near the bottom of stile 22 having aperture 360 with opposite sides spaced apart to slidably engage bolt 30, but to prevent it from rotating therein. The configuration of support members 348 and 358 taken with the hexagonal cross section of bolts 29 and 30 and the fact that the bolts are threadably mounted on connector rods 25 and 26 allow fine adjustment of the distance bolts 29 and 30 protrude above the top and bottom of the door stile 22 respectively. This feature is important since it is desirable to have a high degree of flexability in adjusting the distance the bolts extend beyond the door stile. This distance is most often not known when the door is ordered and the adjustments must be made on the job. In installing a panic exit device of the invention, it is most usual to install the device on the door and then adjust the distance bolts 29 and 30 extend beyond the door in the locking position by rotating them on threaded shafts 25 and 26. Support members 348 and 358 are then installed to retain the bolts in the desired position. Should any changes in conditions occur, it is a simple matter to remove the support members and finely adjust the position of bolts 29 and 30. The hexagonal cross section of the bolt allows adjustments to be made in 1/6 increments of the thread flight length. Of course, other cross sectional shapes such as a square or octagon could be employed to allow different degrees of adjustment.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In combination, a door with a panic actuator apparatus for unlatching said door mounted in and normally maintained in latched engagement with a door frame, said door including a pair of separate stiles along opposite edges and latch actuating means movable for retracting latch means which is normally providing said latched engagement between the door and the door frame, said apparatus comprising:

housing means for said panic actuator comprising a rail of said door extending between and connected to said stiles at opposite ends between opposite faces of said door, said housing including an enlarged opening on one face of said door;

a panic bar mounted in said enlarged opening for relative movement on said door in response to external pressure applied at any point against an outer face of said bar;

means supporting said bar from said housing for linear movement normal to said one face of said door including a pair of pivotal control arms mounted at a first end for rotation about a vertical axis fixed relative to said housing and slidingly engageable with said panic bar at an opposite end;

means interconnecting said bar and said latch actuating means for unlatching said latch means in response to said movement of said bar on said door; and said interconnecting means including a first lever pivotally mounted about a vertical axis and engageable by one of said control arms and a second lever pivotally mounted about a horizontal axis and engageable by said first lever, said second lever having an end slidingly engageable with said latch actuating means for unlatching said latch means.

2. A panic actuator apparatus according to claim 1, wherein said supporting means includes limit means for preventing relative horizontal translation between said bar and said door during said relative movement.

3. A panic actuator apparatus according to claim 1, including bias means engageable between at least one of said control arms and a rear wall of said housing for urging said bar away from said depressed state.

4. A panic actuator apparatus according to claim 1, including key operated dogging means accessible through a front face of said bar for maintaining said bar in a depressed position on said door to retain said latch means in an unlatched condition permitting said door to swing freely open.

5. A panic actuator apparatus according to claim 1, including bias means acting on at least one of said control arms for urging said bar away from said depressed state.

6. A panic actuator apparatus according to claim 1, wherein said control arms are connected by links wherein movement of one arm in one direction causes movement of the other control arm in the same direction.

7. In combination, a door with a panic actuator apparatus for unlatching said door mounted in and normally maintained in latched engagement with a door frame, said door including a pair of separate stiles along opposite edges and latch actuating means movable for retracting latch means which is normally providing said latched engagement between the door and the door frame, said apparatus comprising:

housing means for said panic actuator comprising a rail of said door extending between and connected to said stiles at opposite ends between opposite faces of said door, said housing including an enlarged opening on one face of said door;

a panic bar mounted in said enlarged opening for relative movement on said door in response to external pressure applied at any point against an outer face of said bar;

means supporting said bar from said housing for linear movement normal to said one face of said door including a pair of pivotal control arms mounted at a first end for rotation about a vertical axis fixed relative to said housing and slidingly engageable with said panic bar at an opposite end; and means interconnecting said bar and said latch actuating means for unlatching said latch means in response to said movement of said bar on said door; said supporting means including limit means comprising a roller carried on an arm projecting from a rear wall of said housing which is received in a channel formed parallel to an end wall of said bar for preventing relative horizontal translation between said bar and said door during said relative movement.

8. In a panic exit device, suitable for mounting on a door having an active stile containing a vertically operating locking bolt; a locking bolt retraction mechanism for causing reciprocating movement of the bolt, the retraction mechanism being activated by the vertical upward movement of an actuating pin operably connected to said retraction mechanism; and an actuator device mounted on said door for urging the actuating pin vertically upward; the improvement wherein the actuator device comprises:

an active unit housing mounted adjacent to the active stile;

a panic bar horizontally slidingly mounted in said housing;

a slide lever arm slidingly mounted in the active unit housing having a first end thereof extending from said housing and a second end thereof contained within said housing; and control arms mounted at a first end for rotation about a vertical axis fixed relative to said housing and horizontally slidingly engageable with said panic bar at an opposite end;

a first lever means pivotally mounted about a vertical axis and engageable by one of said control arms; and a second pivotable lever means engageable by said first lever and engageable with said slide lever arm for vertically sliding said arm;

wherein forward and backward horizontal movement of said panic bar is translated into vertical movement of said arm.

9. A panic exit device according to claim 8, including limit means for preventing relative lateral horizontal translation between said bar and said housing during forward and backward horizontal movement of said bar.

10. A panic exit device according to claim 9, wherein said limit means comprises a roller carried on an arm projecting from a rear wall of said housing which is received in a channel formed parallel to an end wall of said bar.

11. A panic exit device according to claim 8, including key operated dogging means accessible through a first face of said bar for maintaining said bar in a depressed position in said housing to retain said arm in a raised condition.

12. A panic exit device according to claim 8, including bias means acting on at least one of said control arms for urging said bar away from said depressed state.

13. A panic exit device according to claim 8, wherein said control arms are connected by links wherein movement of one arm in one direction causes movement of the other control arm in the same direction.

14. A panic exit actuator device comprising:

a mounting base;

a panic bar movable horizontally toward and away from said mounting base;

control arms pivotally secured to said mounting base at one end and slidingly secured to said panic bar at an opposite end;

a slide lever arm vertically slidably mounted on said mounting base, lever means engaged with said slide lever arm and actuated by engagement by at least one of said control arms to translate horizontal movement of said panic bar into vertical movement of said slide lever arm; and key operated dogging means accessible through a front face of said panic bar for maintaining said bar in a depressed position relative to said mounting base to retain said slide lever arm in an elevated position;

wherein said dogging means comprises a rotatable shaft mounted on said mounting plate and carrying a projecting pin engageable upon rotation with a portion of said panic bar to retain said panic bar in said depressed position.

15. A panic exit actuator device comprising:

a mounting base;

a panic bar movable horizontally toward and away from said mounting base;

control arms pivotally secured to said mounting base at one end and slidingly secured to said panic bar at an opposite end;

a slide lever arm vertically slidably mounted on said mounting base, lever means engaged with said slide lever arm and actuated by engagement by at least one of said control arms to translate horizontal movement of said panic bar into vertical movement of said slide lever arm;

wherein said lever means comprises a first lever pivotally mounted about a vertical axis and engageable by one of said control arms and a second lever pivotally mounted about a horizontal axis and engageable by said first lever, said second lever having an end engageable with said slide lever arm.

16. A panic exit actuator device comprising:

a mounting base;

a panic bar movable horizontally toward and away from said mounting base;

control arms pivotally secured to said mounting base at one end and slidingly secured to said panic bar at an opposite end;

a slide lever arm vertically slidably mounted on said mounting base, lever means engaged with said slide lever arm and actuated by engagement by at least one of said control arms to translate horizontal movement of said panic bar into vertical movement of said slide lever arm; and a stop means mounted on said mounting base and engageable with at least one of said control arms to limit the extent of movement of said panic bar away from said mounting base.

17. A panic exit actuator device according to claim 16, including shock absorbing means associated with said stop means to reduce the impact force of said control arm with said stop means.

* * * * *